US006116458A

United States Patent [19]

Dark

[11] Patent Number: 6,116,458

[45] Date of Patent: Sep. 12, 2000

[54] SPORT DRINKING CUP WITH VALVED STRAW CAP

[76] Inventor: Richard C. G. Dark, 2248 Gum Tree La., Fallbrook, Calif. 92028

[21] Appl. No.: 09/257,355

[22] Filed: Feb. 25, 1999

[51] Int. Cl.[7] ..... A47G 21/18

[52] U.S. Cl. ..... 220/709; 220/708

[58] Field of Search ..... 220/709, 708, 220/707, 711, 714, 715, 717, 719

[56] References Cited

U.S. PATENT DOCUMENTS

| | | | |
|---|---|---|---|
| 5,203,468 | 4/1993 | Hsu | 220/254 |
| 5,242,079 | 9/1993 | Stephens et al. | 220/705 |
| 5,339,982 | 8/1994 | Tardie | 220/708 |
| 5,346,081 | 9/1994 | Lin | 215/229 |
| 5,361,934 | 11/1994 | Spence, Jr. | 220/707 |
| 5,392,968 | 2/1995 | Dark | 222/529 |
| 5,465,866 | 11/1995 | Belcastro | 220/709 |
| 5,520,304 | 5/1996 | Lin | 220/707 |
| 5,897,013 | 4/1999 | Manganiello | 220/252 |

*Primary Examiner*—Stephen Castellano
*Attorney, Agent, or Firm*—Ronald M. Goldman

[57] ABSTRACT

An easy-to-operate vented leak-proof drinking cup cap for a bottle is formed by a pivotable drinking spout (3) and diaphragm arrangement (4) in the cap base (7). The drinking spout that forms the mouthpiece on the upper side of the diaphragm through which the user sucks liquid, contains a portion (**3*b*) on the underside the diaphragm. That lower spout portion carries an elastic hose or tube (8) for immersion in the bottle's liquid when the drinking spout is in the open position, whereby the series of passages through the elastic tube and drinking spout serves as a straw. When the spout is pivoted to its closed position and latched, in one movement, the lower portion of the spout swings a portion of the elastic tube against the vent (6), closing the vent, and forces another portion of that hose into an interference surface (12**), creating a bend or kink in the hose that prevents liquid passage.

17 Claims, 1 Drawing Sheet

SPORT DRINKING CUP WITH VALVED STRAW CAP

FIELD OF THE INVENTION

This invention relates to sport drinking cups and, more particularly, to a sport drinking cup that contains a resealable straw-like member.

BACKGROUND

Sports enthusiasts, particularly bicyclists, are accustomed to carrying a container of water along which they are able to efficiently access "on the run" to quench a thirst. One common form for the container is a flexible plastic bottle with a drinking spout that is manually opened and closed. Conveniently, the drinking spout serves as a mouthpiece for the drinker. Moving the spout to the open position, the cyclist inserts the spout into the mouth and squeezes the bottle, expressing drinking water. Another form is a plastic bottle having a plastic drinking straw. Being always open, the cyclists grips the bottle and, with the straw's end in the mouth, squeezes to express the drinking water.

Further, in my patent U.S. Pat. No. 5,392,968 granted Feb. 28, 1995, entitled Dispensing Closure and Method, hereafter referred to as the "Dark '968 patent", a one-piece molded plastic closure for fluids is described that contains a pivotable spout and a compound diaphragm, the disclosure of which is incorporated herein by reference in its entirety. Among other things evident from inspection of the patent there is also described adaptations to that novel closure structure to enable the closure to serve as such a sport drinking cup cap. The structure illustrated in FIGS. 20 and 21 of that patent employs a flexible thin-walled tubular extension integrally formed on the underside of a more rigid thick walled tubular fluid dispensing spout that lies on the underside of the closure base. With the spout in its open position upstanding fluid confined within the associated container or bottle is dispensed through the spout. When the spout is pivoted down to the closed or sealed position and latched, the flexible tubular extension is pressed against a seal member, a plastic member that depends from the underside of the closure base, collapsing and flattening a portion of the tube to close the fluid passage therethrough.

An alternative embodiment described in the patent combines the one-piece closure with a separate flexible straw to form a two-piece structure. As illustrated in FIGS. 22 and 23 of that patent, a flexible plastic straw is inserted through the rigid spout and extends through the closure base and into the liquid confined in the container. When the pivotable spout is pivoted down to the closed or sealed position and latched, the pivoting spout swings the straw around and bends it, pressing a portion of the straw against a seal member, a plastic member that depends from the underside of the closure base, and, as in the preceding structure, collapses and flattens a portion of the straw to block the fluid passage. Although not specifically illustrated, the foregoing drinking cup caps may include a conventional air vent that extends through the closure base to permit liquids to be more easily sucked from the bottle. The vent allows air to enter the bottle as the liquid is sucked out.

Although novel, the foregoing drinking cup cap structures illustrated did not achieve market acceptance for reasons not herein fully described. The soft tube extending out of the mouthpiece was not acceptable and the lack of a vent in the cap made the drinking cup difficult to use.

Preferably air vents employed in the foregoing drinking cup caps are made sufficiently small in size so that the surface tension of the confined liquid alone would prevent any leakage when the cap was closed. One problem with small sized vents in rigid caps is that the liquid can only be sucked from the container as fast as the exterior air can enter, which is an annoyance to some. Further, because of the varied nature of liquids held in the bottle, such as beverages, juices and water, and to minimize the potential for clogging that vent, wherein operation would be more difficult, particularly for uninformed users who may not understand the purpose of the air vent, the approach taken is to use a much wider vent than would otherwise be necessary. As a consequence, the drinking cup cap would allow some minor leakage, and could not be characterized as leak-proof.

Good hygiene is a concern that is sometimes overlooked. To ensure that the drinking cup is sanitary it should be frequently disassembled and washed. The most widely available drinking cup cap uses a push-pull valve, which is formed of two components. That valve is not designed to be dismantled for cleaning. Therefore, even when the drinking cup and cap are washed in a normal manner, particles of juice or other liquids may remain between the two valve components inside the valve, causing contamination. Other drinking caps, such as those imported from China, are manufactured and assembled from an even larger number of components. One such drinking cup product consists of a cap, a straw, an a rubber tube joining the straw to the spout, and an over cap that, when twisted, closes the valve and encapsulates the spout. That product is not designed for cleaning and is almost impossible to sterilize.

A principal object of my invention is to provide a leak-proof drinking cup cap.

Another object of my invention is to provide a leak proof drinking cup that takes advantage of some elements of my prior designs while being more easily manufactured and used.

A further object of my invention is to provide a drinking cup cap that requires less force to unlatch and open making it easier for user's to use a drinking cup "on the run".

And a still further object of my invention is to provide a drinking cup cap that may be easily dissassembled for cleaning.

SUMMARY OF THE INVENTION

In accordance with the foregoing objects and advantages, the drinking cup cap includes a pivotally mounted drinking spout that is manually pivoted, swivelled, about a pivot hinge on the base of the cap, moving between an open position, with the spout upstanding vertically, and a closed position, with the spout oriented horizontal on the upper side of the cap base. The spout includes an extended portion, the lower spout portion, which is located on the under side of the cap base. With the drinking spout being pivoted to the closed position along the upper side surface the lower spout portion simultaneously pivots toward the underside surface of the cap base. The lower spout portion is attached to an elastic tube, a portion of which ensleeves the lower spout portion and the remainder of which extends from the lower spout portion for immersion into liquid within a bottle to which the cap is attached. With the drinking spout open, a user may suck liquid through the mouthpiece, which is aided by a vent passage also contained in the cap base.

When the spout is pivoted to the closed position, the lower spout portion swings the elastic tube about and presses one portion of the elastic tube over the vent passage, and, simultaneously, pinches closed another portion of the elastic tube, thereby sealing the cap. With a single action the cap openings are closed. With both cap openings closed the confined liquid cannot leak or escape from the bottle, nor can external contaminants enter.

Appropriately the drinking cup includes a diaphragm that permits the drinking spout to pivot and a releasible latch to latch the drinking spout in the closed position. In accordance with another feature to the invention, except for the elastic tube, all of the foregoing elements are suitably an integral assembly formed of one-piece of plastic material, suitably polypropylene.

As an advantage, the preferred embodiment contains only two components, the elastic tube and the cap, the latter containing the integrally formed diaphragm and spout. The components may be easily separated and washed. The cap may be washed on the top shelf of the dishwasher, and the elastic tube can be thoroughly flushed out and cleaned. Reassembly is simple and requires no special tools or training.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DETAILED DESCRIPTION OF A PREFERRED EMBODIMENT

Figure 1:
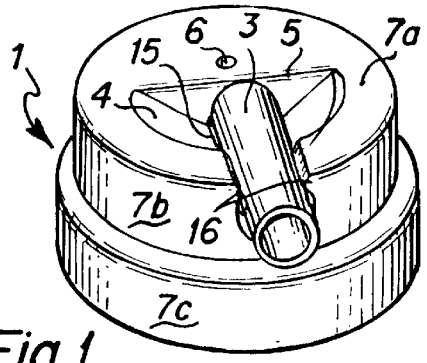
FIG. 1 is a front perspective view of a preferred embodiment of the cap to the drinking cup, illustrated in the closed condition.
Figure 2:
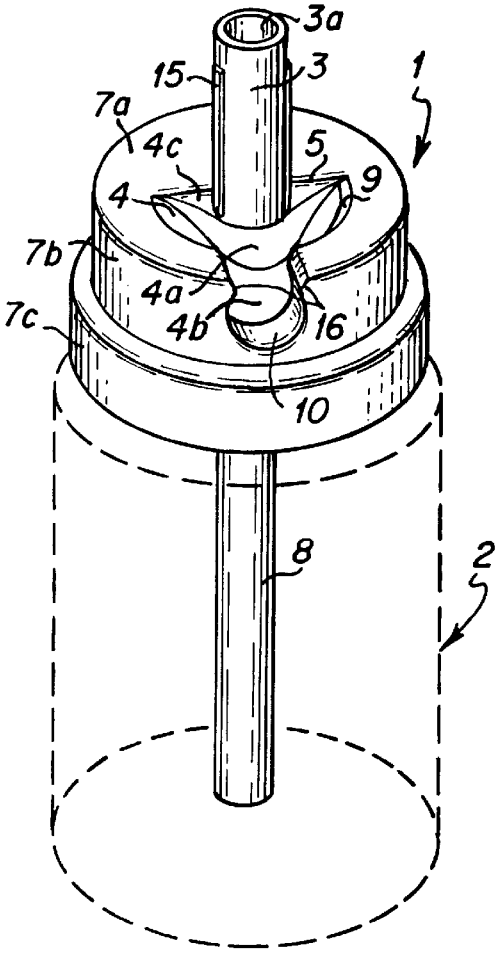
FIG. 2 is an embodiment of the drinking cup containing the drinking cup cap of FIG. 1, illustrated in an open condition, and an associated bottle, partially illustrated.

Concurrent reference is made to FIG. 1 which illustrates my drinking cup cap 1 in a closed position and to FIG. 2 which illustrates the foregoing elements in an open position and, in dash lines, the associated liquid container 2, which, with the foregoing cap, forms a drinking cup. As shown in FIG. 1, the cap includes a pivotable drinking spout 3, diaphragm 4, hinge 5, vent passage 6, located behind the lower or base end of spout 3, all formed on a cap base. In the illustrated embodiment the cap base is formed of a relatively planar upper surface 7*a*, located on the top of cylindrical wall 7*b*, and a cylindrical walled collar 7*c*, slightly larger in diameter than and supporting wall 7*b*. The foregoing configuration of the cap base is preferred, although as those skilled in the art recognize from study of this specification, in other embodiments alternative geometries may be employed.

As illustrated in FIG. 2, cap 1 is attached to the top of container 2, a bottle. Since the drinking cap is intended for use with any conventional screw top plastic or glass bottle, the details of which are not necessary to an understanding of the invention, the bottle need not be further illustrated or described. An elastic tube 8, later herein more fully described, is partially illustrated, extending from the underside of drinking cap 1 and into the bottom region of that bottle.

In FIG. 1, drinking spout 3 is illustrated in its closed position, extending horizontally, pivoted down into a U-shaped recess in the cap base that extends radially through the side. The spout extends slightly beyond the side wall to the cap base, allowing a protruding portion for the user to grip or push against in order to unlatch and pivot the spout up to the open position. In FIG. 2 the drinking spout 3 is illustrated in in the open position, in which the drinking spout is vertically upstanding. The drinking spout is connected to hinge 5, as later herein discussed in greater detail. The hinge is a living hinge integrally formed in the upper surface of the cap base. That hinge defines the pivot axis on which the spout pivots, or more appropriately, swivels, between the spout's open and closed positions and vice-versa.

As in my prior patent, U.S. Pat. No. 5,392,968, pivotable movement of the drinking spout 2 is possible due to the function of diaphragm 4, which is attached to both spout 3 and to the support surfaces of the more rigid cap base. The diaphragm's flexure permits the drinking spout to be pivoted and maintains the continuity of the cap's surfaces in the face of that spout movement.

As later herein described, spout 3, when in the open position, together with elasteic tube 8, forms a straw by means of which the user may suck liquid from bottle 2. Vent passage 6 extends through the upper surface 7*a* and serves as an air vent. When sucking on the end of the drinking spout 3 to draw up liquid, the vent permits external air to pass into the confined region on the underside of the cap base and the liquid confined in bottle 2 which aids in sucking up the liquid.

Figure 3:
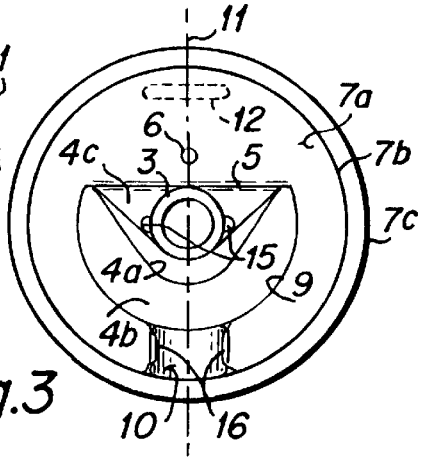
FIG. 3 is a top view of the drinking cup cap of FIG. 2.

Reference is made to FIG. 3 which illustrates the embodiment in a top view with the drinking spout 3 in the open condition as in FIG. 2. The full expanse of diaphragm 4 is visible in this view. Diaphragm 4 consists of an upper or top portion 4*c*, which is relatively rigid, a top flexible portion 4*a* and a lower flexible portion 4*b*. A semi-circular region, recessed from planar top surface 7*a* in the cap base, is bordered on one side by a depending circular wall 9, only partially visible in FIGS. 1 and 2, to which diaphragm 4 is attached. The diaphragm essentially serves as part of the border or surface to that recess.

Circular wall 9 extends in a semi-circle about the base end of spout 3 and is symmetric therewith. The wall's length varies and is determined by the downward slope of diaphragm 4; the wall need be only deep enough to reach and attach the outer edges or border of the diaphragm 4. That wall's depth varies from a maximum at the center to a minimum at each end at hinge 5. Circular wall 9 is relatively rigid and provides a firm support for the diaphragm. In turn the juncture between the diaphragm and that wall permits the diaphragm to flex in the manner described in the Dark '968 patent, during the opening and closing operation of the spout.

The upper planar surface 7*a* is interrupted also by a walled U-shaped recessed portion 10, recessed from the top planar surface, and forms a passage or trench from the aforementioned recessed region, through both the depending circular wall 9 and the outer cylindrical wall 7*b*. The U-shaped region permits the spout to be pivoted to and held down in a horizontal position, as shown, when closed. The U-shaped recess 10 extends radially in line with the plane of rotation of spout 2, represented by line 11, and is wide enough and deep enough to receive the spout. As shown that plane of rotation extends through the axis of spout 3, vent passage 6 and, illustrated in hidden lines, an interference rib 12, the latter located on the underside of the cap's upper surface 7*a*.

The outer edges of lower flexible diaphragm portion 4*b* are attached to the semi-circular wall 9. Upper diaphragm portion 4*c*, specifically two triangular shaped portions, which are integral with of the flexible foldable portion 4*a* of the diaphragm, latter herein more fully described, one of which is located on each side of drinking spout 3. The triangular shaped upper diaphragm portions, being formed with a greater thickness of material and being relatively small in size than diaphragm portions 4*a* and 4*b*, are relatively rigid, relative to those other diaphragm portions. Upper portion 4*c* connect to the cap base along hinge 5 and also connect to spout 3. As shown diaphragm 4 serves also as a barrier to fluid. The only passages through the cap are the fluid passage through spout 3 and vent passage 7.

A pair of axially extending splines 15 are located on diametrically opposite positions on the outer tubular wall at the front end of drinking spout 2. Those splines protrude radially outwardly sideways a short extent. A pair of elongated barbs 16 formed in the opposed side walls to U-shaped region 10, together with splines 15 form a releasible latch that holds spout 3 in the closed position illustrated in FIG. 1, until manually released by the user by pushing up on the distal end of the spout.

Returning to FIG. 2, splines 15, only one of which is fully visible in this view, extend axially along the length of the spout. The spline's length is sufficient to engage barbs 16, molded within the side walls of U-shaped recess 10, when the spout is pivoted down.

Figure 4:
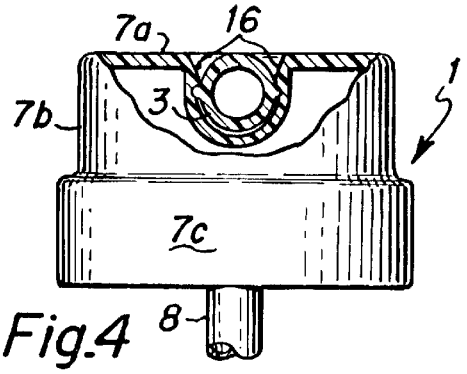
FIG. 4 is a front partial section view of FIG. 1, illustrating the integrally formed latch.

Reference is made to FIG. 4, which is a partial front section view of FIG. 1, and better illustrates the position of the latch member when the spout is latched. As shown, the upper surface of each barb 16 is tapered downward for a short vertical distance, forming a cam surface, and then drops off horizontally. The ends of splines 15 on the spout are spaced apart horizontally a greater distance that the distance between the sloped portions of those barbs, but is spaced about the same distance as the ends of the horizontal portion of those barbs, located at the supporting walls.

To latch spout 3 closed, the user presses down on the spout to force the spout in its closed and latched position. In being pivoted down for closing, splines 15 encounter the cam or sloped surface of barbs 16, which initially provides an obstruction. The downward force exerted by the user must be sufficient to outwardly flex the side walls of the U-shaped cap portion 10 supporting barbs 16, and/or, through the splines, inwardly resiliently compress the spout, in order to move the spout down past the horizontal portion of barbs 16 and latch it in place.

Once splines 15 have moved past the tapered portion of the barbs, the flexed surfaces elastically return to their original shape and the barbs overlie the splines. Splines 15 catch and are held by the horizontally oriented surface of barbs 16, which now hold the spout down against any upward force that may be exerted by resiliency in diaphragm 3 and, as later herein described, by the elastic force in tube 8.

Figure 5:
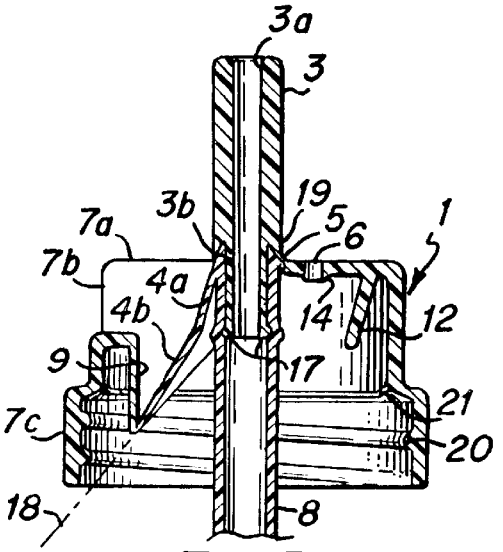
FIG. 5 is a side section view of the drinking cup cap as illustrated in FIG. 2.

Referring next to the section view of FIG. 5, the drinking cap 1 is seen as essentially being a hollow body, formed of relatively thin walls that provides a cavity region on the underside of the upper surface 7*a*, bounded by cylindrical walls 7*b* and 7*c*, the diaphragm and spout. An edge of vertical circular wall 9 to the recessed region is visible in this view. The height of circular wall 9 at any angular position about the axis of the spout 3 varies with the location of the position of outer edge of diaphragm portion 4*b*, which extends upwardly at a steep angle relative to horizontal surface 7*a*. Vent passage 6 is radially displaced in position from the axis of spout 3, and from the pivot axis at hinge 5. The underside of the vent passage is also preferably surrounded by a seal 14, formed as a circular protruding portion of the underside of cap surface 7*a*.

Interference rib 12 is formed integral with the underside of the closure's horizontal planar surface 7*a* and is positioned a greater distance away from the axis of the spout 3 and hinge 5, and is positioned along a radial line 11, illustrated in FIG. 3, that intersects both the spout's axis and vent passage 6. Suitably Interference rib 12 extends down into the underside cavity region to provide a radially inwardly inclined surface oriented at an angle to the vertical, of between about five and ten degrees in a practical embodiment, angled toward and facing spout 3. As later herein described the slight angle allows the interference rib to serve a second spout latching function in combination with elastic tube 8.

Continuing with FIG. 5, drinking spout 3 contains an integral extension or, as variously termed, lower spout portion 3*b*, located on the underside of diaphragm 4 beneath upper surface 7*a* to complete the fluid passage through the spout, from the upper side of the cap base to the under side. The foot end of the lower spout portion supports a retainer ring 17, an enlarged outer diameter portion or ring that radially outwardly protrudes from the tubular wall of the spout.

In this embodiment the lower spout portion 3*b* is of a restricted outer diameter relative to the upper portion. The length of the lower spout portion is great enough to span at least the radial distance to vent passage 6, when spout 3 is pivoted about hinge 5 to the closed position, but not so great in length as to contact interference rib 12. Elastic tube 8 fits over and ensleeves that lower spout portion, frictionally engaging the lower portion's outer cylindrical wall and is secured in place on that spout portion by the frictional force of retaining ring 17, which elastically expands a small portion of the tube wall. The remaining portion of the elastic tube is suspended from the spout. The elastic tube, only partially illustrated in the figure, is of sufficient length to extend to the bottom region of the associated bottle and, like a straw, is intended to be immersed within any liquid confined in that bottle when the spout is in the open position.

Figure 6:
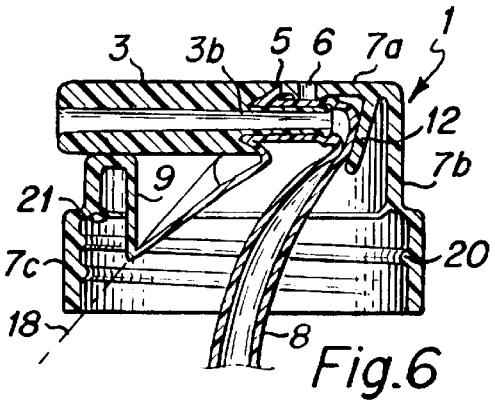
FIG. 6 is a side section view of the drinking cup cap in the closed condition as illustrated in FIG. 1.

When spout 3 is pivoted down to the closed position, as illustrated in the section view of FIG. 6 to which reference is next made, the lower end of the spout swings elastic tube 8 up against the underside of the closure's upper surface 7*a*, pressing the tube's elastic material against seal 14 on the underside of that surface and covering vent passage 6. It also presses another portion of that elastic tube against interference rib 12, producing a bend in the tube, and collapsing the tube walls between the lower spout portion's foot end and the confronting surface of the interference rib. The collapsed or "kinked" tube walls thereby block the fluid passage through the tube.

As noted earlier, interference rib 12 is inclined at a five to ten degree angle to the vertical (or ninety to ninety five degrees to the horizontal) toward the spout. The angle creates a second latch method that helps elastic tube 8 to stay in a sealed position when the spout is in the closed position. As spout 3 is pivoted to the sealed position, shown in FIG. 6, the elastic tube first engages the lower end of interference rib 12. With the user exerting downward force on the spout, a portion of that tube, located below the end of tube extension 3*b*, is squeezed past that rib, temporarily compressing the tube at that portion. As that portion is moved upward above the end of the interference rib into the laterally wider region close to the underside of top surface 7*a*, the portion resiliently expands slightly, as the other portion of the tube engages the vent seal. That expansion allows the resilient force of the tube walls to assist in holding the bottom end of the spout in the horizontal, closed position illustrated in the figure. To move the spout end out of the closed position, thus, the force must be sufficient to re-squeeze that portion of the elastic tube. By contributing to the latching function in the foregoing way, it is possible to reduce the strength of the earlier described latch at the front end of the spout.

The portion of the elastic tube 8 sealing the air vent is supported by the rigid walls of the lower spout portion, while the tube portion carried into the bend is a suspended portion. It is appreciated that the foot end of the lower spout portion is sufficiently distant from interference rib 12 so that the kink is preferably positioned slightly below the foot end when the spout is pivoted down as illustrated. That positioning minimizes the force necessary to pivot the spout down and maintain it latched in place.

Reference is again made to FIG. 5. Diaphragm 4 is preferably a compound diaphragm described in the Dark '968 patent to which reference may be made for a more detailed description and which is incorporated herein by reference. Essentially the diaphragm is formed of two types of diaphragms that are serially connected together in between the cap base and the spout 3, comprising an invertible diaphragm 4*a* and a flexible foldable diaphragm 4*b* the edges of which are illustrated in the figure.

In the specific embodiments illustrated in that prior patent, a bi-sector plane is illustrated oriented at an angle of forty five degrees to the plane of the planar upper surface of the cap base, such as the horizontal plane of the upper surface 7*a*, illustrated in FIG. 5. Plane line 18 represents a bisector plane in drinking cap 1 that contains the border of the diaphragm 4 and extends through hinge 5. In the present invention, that angle between bi-sector plane 18 and the horizontal is made more shallow, specifically forty degrees. When swiveling spout 3 from the vertically upstanding open position to the closed position, the spout pushes on flexible diaphragm 4*b*, which in turn pulls or swivels the invertible diaphragm 4*a* down through the bi-sector plane.

With the forty degree angle the invertible diaphragm 4*a* component of the compound diaphragm inverts, that is, passes through the top dead center position, the bi-sector plane 18, but does not invert as fully, as occurs in the design shown in the Dark '968 patent in which the forty five degree angle is employed, before a fold over action of foldable diaphragm 4*b* component occurs. The description of the diaphragm's movement during closing, and opening of the spout, is adequately described in the prior Dark '968 patent, which is incorporated herein by reference, and not here repeated.

With full invertible diaphragm inversion it was found that a residual propensity for the diaphragm to pull up slightly occurs, pivoting the spout back by up to five degrees of arc, from the position in which the spout is closed, assuming the spout latch is removed or disabled. Such residual force appears to be due to the fact that the polypropylene material of which the diaphragm is preferably constructed, unlike rubber, does not completely "relax" in the inverted position, and the diaphragm material is distorted along the outer edges. That return or spring back force is small, and much much smaller than the force required to move the diaphragm back through the top dead center position of the invertible plane.

For the most part the invertible diaphragm's residual spring back force is of little or no concern, since the closure's spout latch holds the spout down tightly sealed, and, accordingly, so is the attached diaphragm. Due to the nature of a sport drinking bottle's use, however, one desires to make the drinking bottle as easy to open as possible. To achieve that ease, a latch for the spout should be designed to be less strong than in the foregoing closures of the Dark '968 patent. Since the latch 15 and 16 must handle the described residual spring back force created by the diaphragm's inversion, the problem addressed was to reduce or divert that force. The present invention accomplishes that by reducing the angle of the diaphragm from forty-five degrees to forty degrees. Such change is found to reduce that spring back force to a lower level. The invertible diaphragm portion is no longer required to fully invert when the spout is sealed closed. The spout latch may now be of a weaker design and, hence, is easier to release.

As illustrated in FIG. 5, drinking spout 3 is attached to the diaphragm 4 by a connecting portion at a position slightly above the horizontal surface 7*a* of the cap base to enable the drinking spout to swivel about the pivot axis of hinge 5. The smaller diameter lower spout portion 3*b* therefore extends up to a position slightly above surface 7*a*. That permits diaphragm 4 to be slightly greater in size, which facilitates pivoting of the spout between its open and closed positions.

As shown in FIGS. 5 and 6, cylindrical wall 7*c* serves as a collar for connecting drinking cap 1 to bottle 2. The internal side of that wall contains an appropriate screw thread 20 molded into the wall for attaching the drinking cap to screw-type container or bottle 2, earlier illustrated in FIG. 2, and a flexible annulus 21 that extends from an inner cylindrical wall and is integral therewith. That annulus is radially inwardly directed and is downwardly sloped and is oriented to engage the top edge of the associated drinking bottle and serves as a liquid seal. It is recognized that other conventional side wall configurations may be substituted to connect the cap to the bottle, all of which come within the scope of my invention.

As those skilled in the art appreciate from the side section view of FIG. 5, all of the foregoing elements of the drinking cup cap, excepting the elastic tube 10, may be molded from one piece of plastic material, suitably polypropylene, as example, in the manner described in the Dark '968 patent, and forms an integral unitary one-piece structure. Preferably elastic tube 8 is formed of rubber. Less preferred embodiments may use a tube formed of polypropylene material. However, polypropylene creeps, a disadvantage, while rubber is easier to repeatedly stretch and compress, which makes it prefereable.

The foregoing provides a leakproof drinking cup cap that is easy to open and close. It is formed of only two component pieces which are easily assembled together. It is easy to disassemble and clean. One need only remove the cap from the bottle and open the spout, pull off the elastic tube 8, which is only frictionally held in place. The cap may be washed by hand or in the top shelf of the dishwasher, and the tube can be flushed and cleaned, leaving no trace of any beverage. The bottle may be separately cleaned. Reassembly is equally simple. The end of elastic tube 8 is simply forced onto the lower spout portion 3*b*, elastically expanding the tube end over the ring 17. As is apparent, no special tools or training is required.

It is believed that the foregoing description of the preferred embodiments of the invention is sufficient in detail to enable one skilled in the art to make and use the invention. However, it is expressly understood that the detail of the elements presented for the foregoing purpose is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. A leakproof vented drinking cup cap comprising a base having top and bottom surfaces, and a vent passage through said base; a pivotable spout extending through said base, said spout having first and second ends and a fluid passage therethrough, said spout being pivotable between a closed position in which said spout is oriented alongside said base and an open position in which said spout is oriented upstanding from said base; said pivotable spout and said base comprising a unitary assembly formed of one piece of plastic material; an elastic tube coupled to said second end of said spout to define with said spout a straw for passing fluid there through; said spout for carrying said elastic tube to a position covering said vent passage to prevent fluid leakage through said vent passage and for kinking said elastic tube to block fluid passage there through, when said spout is moved to said closed position.

2. A resealable drinking cup cap comprising:

a cap base;

a drinking spout and a diaphragm moved by said drinking spout mounted on said cap base;

said drinking spout being pivotally mounted to said cap base for swiveling movement between an open position and a closed position and said diaphragm being connected between said cap base and said spout, wherein said diaphragm at least in part swivels responsive to said drinking spout moving between said open position and said closed position;

said drinking spout including an upper spout portion located on an upperside of said cap base and a lower spout portion located principally on an underside surface of said cap base;

an interference surface protruding downwardly from said underside surface of said cap base, said interference surface facing and being angularly inclined toward said lower spout portion;

a vent passage through said cap base for normally venting the underside of said cap base when said drinking spout is in said open position, said vent passage being located in said cap base between and radially aligned with said upper spout portion and said interference surface; and latch means for releasibly latching said drinking spout in the closed position; and, further comprising:

an elastic tube, said elastic tube having elastically collapsible tubular walls, said elastic tube having an upper end portion attached to and ensleeving said lower spout portion and a suspended portion suspended from said lower spout portion;

said lower spout portion for swinging said upper end portion of said elastic tube along said underside of said cap surface to cover said vent passage, responsive to said spout being moved into said closed position, and, simultaneously, swinging said suspended portion of said elastic tube into contact with said interference surface to bend and squeeze closed said suspended portion of said elastic tube between a bottom end of said lower spout portion and said seal surface, to thereby close said drinking cup cap.

3. The invention as defined in claim 2, further comprising: a liquid container for confining liquid, said liquid container including an open top; and wherein said drinking cup cap further includes: a collar; fastening means carried by said collar for fastening said drinking cup cap to said open top; and a seal for providing a liquid tight seal between said drinking cup cap and said open top when said drinking cup cap is fastened thereto.

4. The invention as defined in claim 3 wherein said diaphragm is a compound diaphragm and comprises:

a flexible diaphragm and an invertible diaphragm serially connected between a lower end of said upper spout portion and said cap base;

said invertible diaphragm providing an over dead center arrangement that pre-loads said drinking spout in the direction of said open position, responsive to said drinking spout being in the dispensing position, and pre-loads said drinking spout in the direction of said closed position, responsive to said drinking spout being moved from said open position toward said closed position;

said flexible diaphragm and said invertible diaphragm being angularly inclined relative to one another to define a crease there between responsive to said drinking spout being in said open position;

said flexible diaphragm including a top end connected to said lower end of said upper spout portion and defining a bend line therewith at said top end, said flexible diaphragm being bendable relative to said drinking spout at said connection with said lower end;

said lower end of said drinking spout being movable in an arcuate path to push said flexible diaphragm during the initial course of travel of said drinking spout from said open position to said closed position and, through said flexible diaphragm, to invert said invertible diaphragm and, during additional movement to said closed position, to place said flexible diaphragm in a position underlying said upper spout portion;

said flexible diaphragm being adapted to swivel about and be pushed and then be pulled by said arcuately moving lower end of said upper spout portion, whereby said flexible diaphragm is temporarily wrapped over and forms a bend therein at said lower end of said upper spout portion and is placed in a position underlying said upper spout portion responsive to said drinking spout attaining the closed latched position.

5. The invention as defined in claim 2, wherein said lower spout portion is of a predetermined length, said length being greater than the distance between said vent passage and said upper spout portion and less than the distance between said upper spout portion and said interference surface, when said spout is in the open position.

6. The invention as defined in claim 4, wherein said lower spout portion is of a predetermined length, said length being greater than the distance between said vent passage and said upper spout portion and less than the distance between said upper spout portion and said interference surface, when said spout is in the open position.

7. The invention as defined in claim 2, wherein said cap base, said diaphragm, said spout, said interference surface and said latch means comprise an integral assembly formed in one-piece of plastic material.

8. The invention as defined in claim 2, wherein said cap base further includes a hinge for pivotally mounting said drinking spout to said cap base, said hinge being integrally formed in said cap base and defining a pivot axis.

9. The invention as defined in claim 7, wherein said cap base further includes a hinge for pivotally mounting said drinking spout to said cap base, said hinge being integrally formed in said cap base and defining a pivot axis.

10. The invention as defined in claim 9, wherein said plastic material comprises polypropylene, and wherein a distal edge of said diaphragm, most remote from said drinking spout, and said pivot axis define a bi-sector plane, said plane being oriented at an angle of 40 degrees relative to a reference plane, said reference plane being oriented normal to the axis of said drinking spout when said drinking spout is in the open position.

11. The invention as defined in claim 5, wherein said angular incline of said interference surface is a predetermined angle in the range of from five degrees to no greater than ten degrees from the vertical, said vertical being defined by the axis of said spout when said spout is in the open position.

12. The invention as defined in claim 7, wherein said elastic tube consists of rubber.

13. The invention as defined in claims 9, wherein said angular incline of said interference surface is a predetermined angle in the range of from five degrees to no greater than ten degrees from the vertical, said vertical being defined by the axis of said spout when said spout is in the open position.

14. The invention as defined in claim 13, wherein said cap base includes a radially extending U-shaped recessed portion for receiving said spout, when said spout is in the closed position, said U-shaped recessed portion including side walls; and wherein said latch means comprises:

a pair of splines located on diametrically opposite sides of and extending in parallel to the axis of said spout; and a pair of barbs located on respective ones of said side walls of said radially extending U-shaped recessed portion, said barbs containing a cam surface.

15. The invention as defined in claim 2, wherein said spout is of a length sufficient to extend beyond and overhang the side of the upper surface of said cap base, when said spout is latched in said closed position, for providing a gripping surface.

16. A resealable drinking cup cap comprising:

a cap base;

a drinking spout and a diaphragm moved by said spout mounted on said cap base;

said spout being pivotally mounted to said cap base for swiveling movement between an open position and a closed position and said diaphragm being connected between said cap base and said spout, wherein said diaphragm at least in part swivels responsive to said drinking spout moving between said open position and said closed position;

a living hinge connected between said cap base and said drinking spout for pivotally mounting said drinking spout to said cap base, said hinge being integrally formed in said cap base and defining a pivot axis;

said drinking spout including an upper spout portion located on an upperside of said cap base and a lower spout portion located principally on an underside surface of said cap base;

said diaphragm further comprising:

a flexible diaphragm and an invertible diaphragm serially connected between a lower end of said upper spout portion and said cap base;

said invertible diaphragm providing an over dead center arrangement that pre-loads said drinking spout in the direction of said open position, responsive to said drinking spout being in the dispensing position, and pre-loads said drinking spout in the direction of said closed position, responsive to said drinking spout being moved from said open position toward said closed position;

said flexible diaphragm and said invertible diaphragm being angularly inclined relative to one another to define a crease therebetween responsive to said drinking spout being in said open position;

said flexible diaphragm including a top end connected to said lower end of said upper spout portion and defining a bend line therewith at said top end, said flexible diaphragm being bendable relative to said drinking spout at said connection with said lower end;

said lower end of said drinking spout being movable in an arcuate path to push said flexible diaphragm during the initial course of travel of said drinking spout from said open position to said closed position and, through said flexible diaphragm, to invert said invertible diaphragm and, during additional movement to said closed position, to place said flexible diaphragm in a position underlying said upper spout portion;

said flexible diaphragm being adapted to swivel about and be pushed and then be pulled by said arcuately moving lower end of said upper spout portion, whereby said flexible diaphragm is temporarily wrapped over and forms a bend therein at said lower end of said upper spout portion and is placed in a position underlying said upper spout portion responsive to said drinking spout attaining the closed latched position;

wherein a distal edge of said diaphragm, most remote from said drinking spout, and said pivot axis define a bi-sector plane, said plane being oriented at an angle of forty degrees relative to a reference plane, said reference plane being oriented normal to the axis of said drinking spout when said drinking spout is in the open position;

an interference surface protruding downwardly from said underside surface of said cap base, said interference surface facing and being angularly inclined toward said lower spout portion;

a vent passage through said cap base for normally venting the underside of said cap base when said spout is in said open position, said vent passage being located in said cap base between and radially aligned with said upper spout portion and said interference surface; a seal for said vent passage on said underside of said cap base, said seal bordering said vent passage and protruding from said underside;

said lower spout portion being of a predetermined length, said predetermined length being greater than the distance between said vent passage and said upper spout portion and less than the distance between said upper spout portion and said interference surface when said spout is in the open position; and latch means for releasibly latching said spout in the closed position, said latch means including a pair of splines, said splines axially extending and radially outwardly protruding from diametrically opposite sides of said upper spout portion, and a pair of latch barbs located in said cap base for engagement with said splines;

said cap base, said diaphragm, said drinking spout, said interference surface and said latch means comprising an integral assembly formed in one-piece of polypropylene plastic material and, further comprising:

an elastic tube, said elastic tube having elastically collapsible tubular walls, said elastic tube having an upper end portion attached to and ensleeving said lower spout portion and a suspended portion suspended from said lower spout portion;

said lower spout portion for swinging said upper end portion of said elastic tube into contact said vent seal along said underside of said cap surface to cover said vent passage, responsive to said drinking spout being moved into said closed position, and, simultaneously, swinging said suspended portion of said elastic tube into contact with said interference surface to bend and squeeze closed said suspended portion of said elastic tube between a bottom end of said lower spout portion and said seal surface, to thereby close said drinking cup cap.

17. The invention as defined in claim 16, wherein said elastic tube comprises rubber; and wherein said angular incline of said interference surface is a predetermined angle in the range of from five degrees to no greater than ten degrees from the vertical, said vertical being defined by the axis of said spout when said spout is in the open position.

* * * * *